US012439964B2

(12) United States Patent
Zhou et al.

(10) Patent No.: US 12,439,964 B2
(45) Date of Patent: Oct. 14, 2025

(54) VAPORIZATION BASE, VAPORIZER, AND ELECTRONIC VAPORIZATION DEVICE

(71) Applicant: SHENZHEN SMOORE TECHNOLOGY LIMITED, Guangdong (CN)

(72) Inventors: Weidong Zhou, Shenzhen (CN); Xiao'an Zhu, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 534 days.

(21) Appl. No.: 17/816,521

(22) Filed: Aug. 1, 2022

(65) Prior Publication Data

US 2023/0042770 A1 Feb. 9, 2023

(30) Foreign Application Priority Data

Aug. 9, 2021 (CN) ..... 202121845156.1

(51) Int. Cl.
*A24F 40/40* (2020.01)
*A24F 40/10* (2020.01)

(52) U.S. Cl.
CPC ..... *A24F 40/40* (2020.01); *A24F 40/10* (2020.01)

(58) Field of Classification Search
None
See application file for complete search history.

(56) References Cited

U.S. PATENT DOCUMENTS

| | | | | |
|---|---|---|---|---|
| 2017/0360098 | A1* | 12/2017 | Newcomb | H05B 1/0227 |
| 2020/0113246 | A1* | 4/2020 | Barbaric | A24F 40/53 |
| 2021/0307394 | A1* | 10/2021 | Chen | A24F 40/48 |
| 2023/0063069 | A1* | 3/2023 | Lei | A24F 40/44 |

FOREIGN PATENT DOCUMENTS

| | | | | |
|---|---|---|---|---|
| CN | 208300942 | U * | 1/2019 | A24F 40/60 |
| CN | 210445695 | U * | 5/2020 | A24F 40/60 |
| CN | 112617291 | A * | 4/2021 | A24F 40/46 |
| CN | 112716039 | A * | 4/2021 | A24F 40/10 |
| EP | 3622989 | A1 * | 3/2020 | A61M 15/06 |
| GB | 2548647 | A * | 9/2017 | A61M 15/002 |
| WO | WO-2020034770 | A1 * | 2/2020 | A24F 40/46 |
| WO | WO-2021226835 | A1 * | 11/2021 | A24F 40/485 |

OTHER PUBLICATIONS

CN_112716039_A English Translation (Year: 2021).*
CN_210445695 English Translation (Year: 2020).*
CN_112617291 English Translation (Year: 2021).*
CN_112617291 English Translation (Year: 2019).*

* cited by examiner

*Primary Examiner* — Manley L Cummins, IV
(74) *Attorney, Agent, or Firm* — Leydig, Voit & Mayer, Ltd.

(57) ABSTRACT

A vaporization base of a vaporizer, for loading a vaporization component of the vaporizer and sealing one end of the vaporizer, includes: at least one notch on the vaporization base. When the vaporization base is mounted, the notch engages with a mounting fixture. In an embodiment, a contour of a cross section of a part of the vaporization base that is provided with the at least one notch is an ellipse or an ellipse-like shape, and the at least one notch is provided on an end portion of a major axis and/or an end portion of a minor axis of the ellipse or ellipse-like shape.

11 Claims, 7 Drawing Sheets

VAPORIZATION BASE, VAPORIZER, AND ELECTRONIC VAPORIZATION DEVICE

CROSS-REFERENCE TO PRIOR APPLICATION

Priority is claimed to Chinese Patent Application No. CN 202121845156.1, filed on Aug. 9, 2021, the entire disclosure of which is hereby incorporated by reference herein.

FIELD

The present application relates to the field of electronic vaporization technologies, and in particular, to a vaporization base, a vaporizer, and an electronic vaporization device including the vaporizer.

BACKGROUND

A vaporizer generally includes a vaporization core, a shell, and a base, and the vaporization core is arranged between the base and the shell, to heat and vaporize a vaporizable substrate. With the popularization and improvement of automation, the automatic assembly degree of the vaporizer is gradually improved. For a conventional vaporizer, when the base is placed in the shell, a success rate that the base is clamped by a mechanical arm is not high due to a shape of the base, thereby affecting the assembly efficiency of the vaporization base and the entire vaporizer.

SUMMARY

In an embodiment, the present invention provides a vaporization base of a vaporizer, configured to load a vaporization component of the vaporizer and seal one end of the vaporizer, comprising: at least one notch on the vaporization base, wherein, when the vaporization base is mounted, the notch is configured to engage with a mounting fixture.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
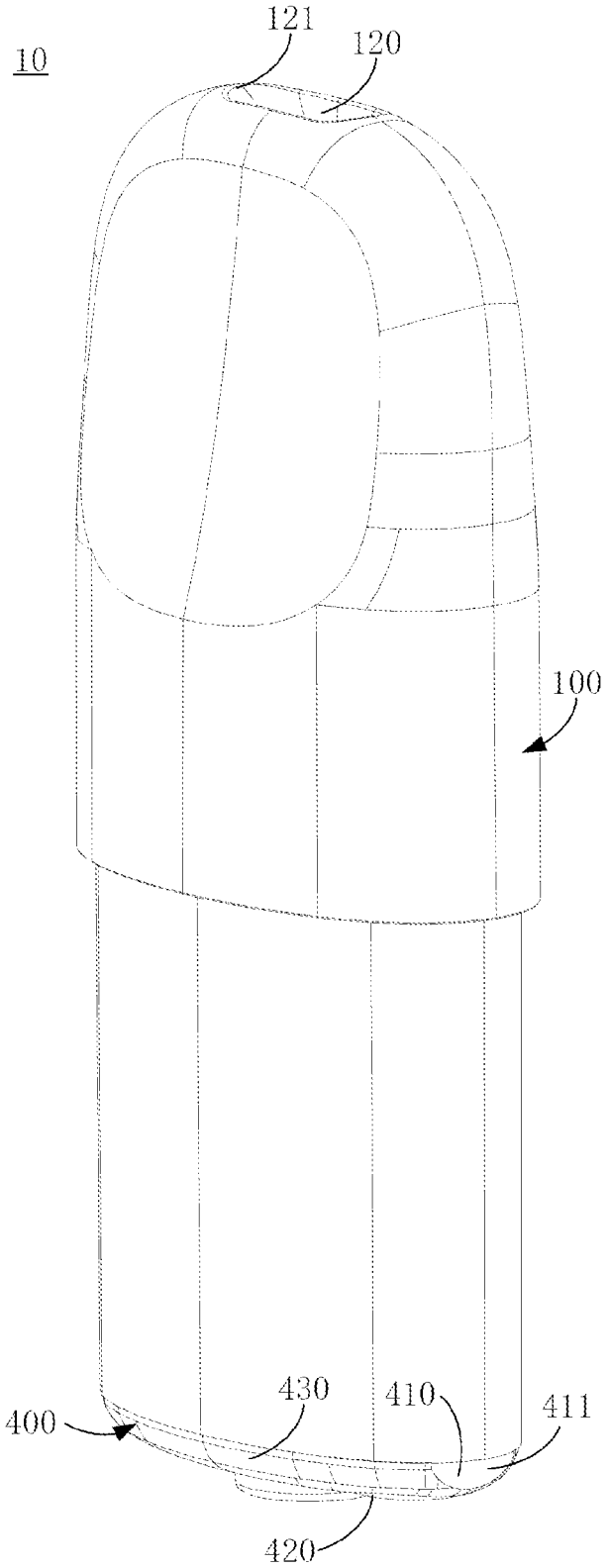
FIG. 1 is a three-dimensional schematic structural diagram of a vaporizer according to a first embodiment.

In an embodiment, the present invention provides a vaporization base that is easy to mount, a vaporizer, and an electronic vaporization device.

In an embodiment, the present invention provides a vaporization base configured to load a vaporization component of a vaporizer and seal one end of the vaporizer, where at least one notch is provided on the vaporization base, and when the vaporization base is mounted, the notch is configured to engage with a mounting fixture.

In an embodiment, a contour of a cross section of a part of the vaporization base that is provided with the notch is an ellipse or an ellipse-like shape, and the notch is provided on an end portion of a major axis and/or an end portion of a minor axis of the ellipse or ellipse-like shape.

In an embodiment, a shaping surface of the notch is a flat surface.

In an embodiment, a shaping surface of the notch is a curved surface.

In an embodiment, the shaping surface of the notch is a smooth transition curved surface or a curved surface formed by a plurality of flat surfaces connected at angles.

In an embodiment, the notch is provided on a side of the vaporization base facing away from the vaporization component.

In an embodiment, a shape of a projection of the notch on a cross section of the vaporization base is at least one of a rectangle, a diamond, a circle, or an ellipse.

In an embodiment, there are at least two notches, and the notches are symmetrically provided on the vaporization base.

A vaporizer is provided, including a shell and the vaporization base according to any one of the foregoing.

In an embodiment, a counterbore is provided on the side of the vaporization base facing away from the vaporization component, a mounting hole is provided on a side of the vaporization base facing the vaporization component, the mounting hole is in communication with the counterbore, and a hole diameter of the counterbore is greater than a hole diameter of the mounting hole; and the vaporizer further includes an electrical connector, and the electrical connector engages with the counterbore and the mounting hole.

In an embodiment, the vaporizer further includes a seal member sleeved on a side of the vaporization base facing the vaporization component, where an air inlet channel is provided on the vaporization base, and a plurality of air guide holes for communication with the air inlet channel are provided on a part of the seal member covering the air inlet channel.

In an embodiment, the notch is at least partially exposed to the outside of the shell.

An electronic vaporization device is provided, including a power supply component and the vaporizer described above, where the vaporizer is connected to the power supply component.

A technical effect of an embodiment of the present application is as follows: Because a notch is formed on the vaporization base, when the vaporization base is clamped by an external mechanical arm, a mounting fixture of the external mechanical arm engages with the notch. When the mounting fixture applies an action force from outside to inside to a cavity of the vaporization base relative to the shell, the notch exerts a good limitation effect on the mounting fixture, thereby preventing the mounting fixture from sliding off the vaporization base, ensuring that the mounting fixture can always clamp the vaporization base stably and reliably, and ensuring that the mounting fixture can implement assembly of the vaporization base through only one clamping, so that the mounting fixture does not need to clamp the vaporization base repeatedly for a plurality of times. Therefore, the assembly efficiency of the vaporization base can be improved.

To help understand the present application, the following describes the present application more comprehensively with reference to the related accompanying drawings. The accompanying drawings show exemplary implementations of the present application. However, the present application may be implemented in many different forms, and is not limited to the implementations described in this specification. On the contrary, the implementations are provided to make understanding of the disclosed content of the present application more comprehensive.

It should be noted that, when a component is referred to as "being fixed to" another component, the component may be directly on the another component, or an intermediate component may be present. When a component is considered to be "connected to" another component, the component may be directly connected to the another component, or an intermediate component may also be present. The terms "inner", "outer", "left", "right", and similar expressions used in this specification are only for purposes of illustration but not indicate a unique implementation.

Figure 2:
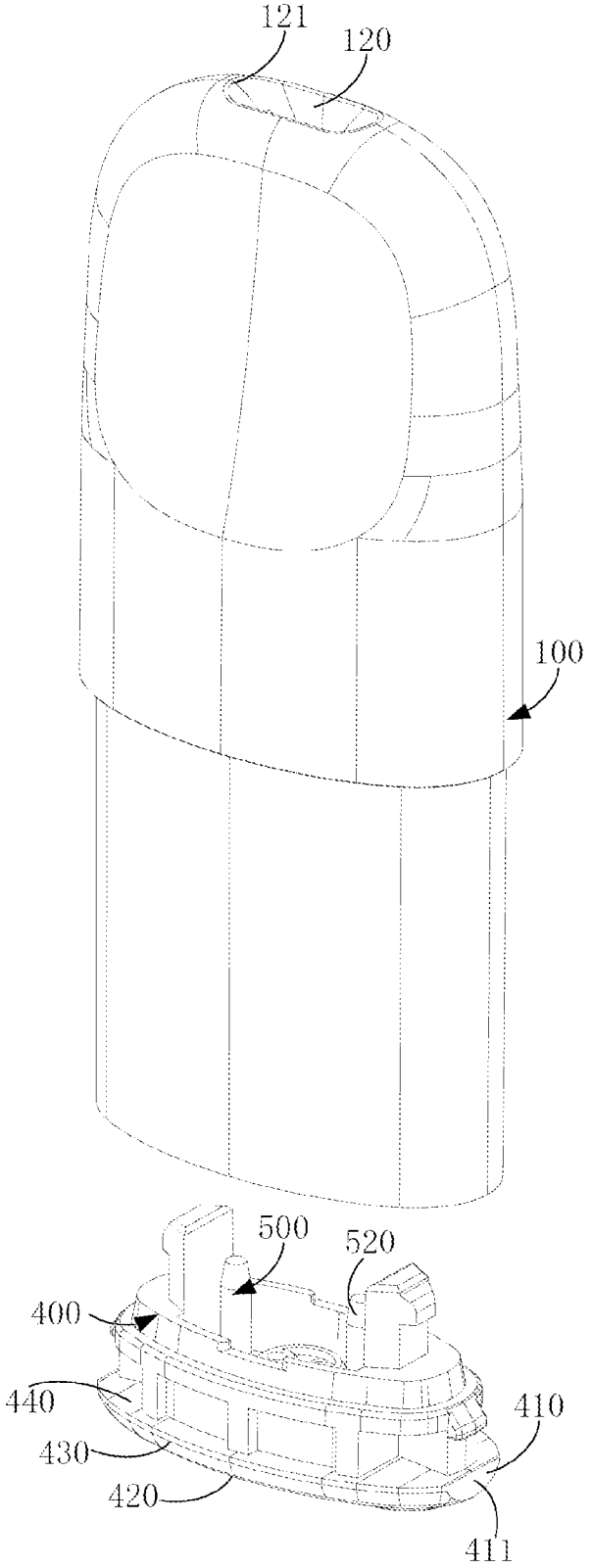
FIG. 2 is a schematic exploded structural view of the vaporizer shown in FIG. 1.
Figure 3:
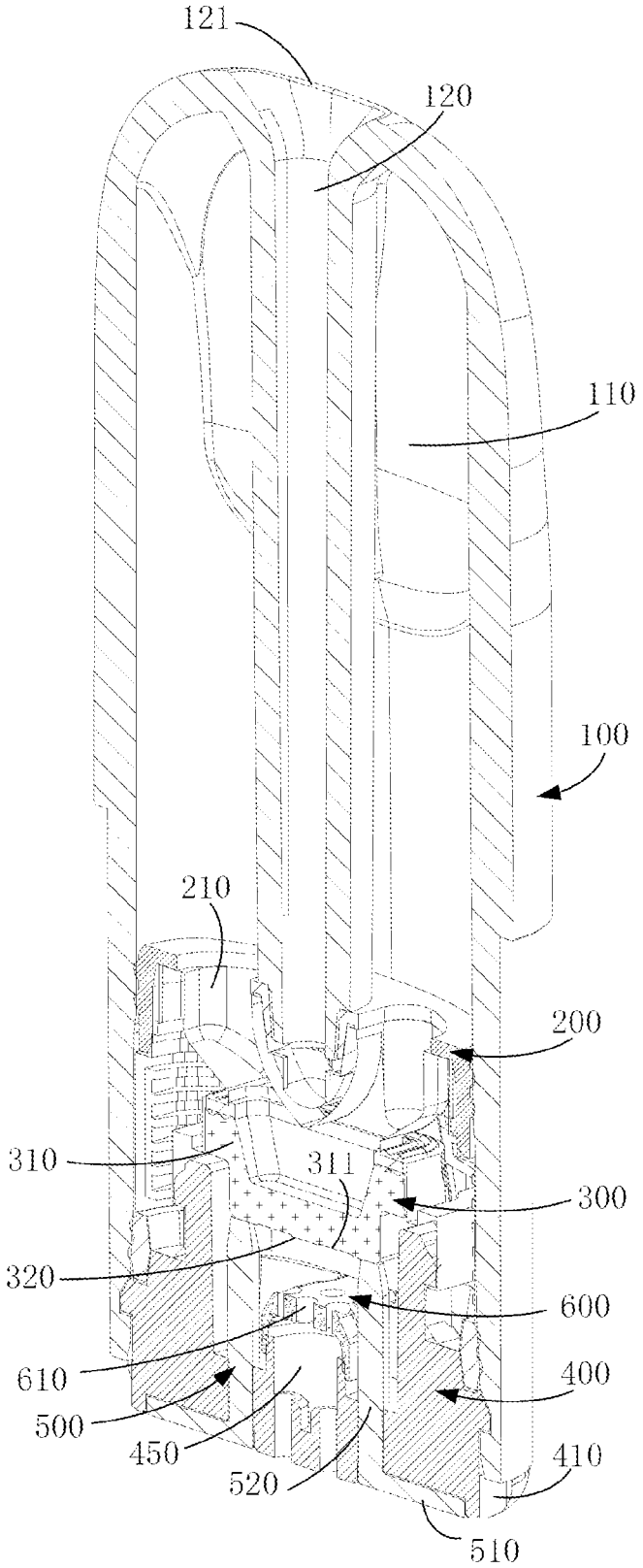
FIG. 3 is a three-dimensional schematic cross-sectional structural view of a vaporizer according to a second embodiment.

Referring to FIG. 1, FIG. 2, and FIG. 3, a vaporizer 10 according to an embodiment of the present application includes a shell 100, a top cap 200, a vaporization core 300, a vaporization base 400, and an electrical connector 500. The top cap 200 and the vaporization core 300 may be both accommodated in a cavity encircled by the shell 100, the vaporization core 300 is arranged between the top cap 200 and the vaporization base 400, and the vaporization core 300 and the top cap 200 may be considered as a vaporization component, namely, the vaporization component includes the top cap 200 and the vaporization core 300. The vaporization base 400 may load the vaporization component. The vaporization base 400 and the electrical connector 500 are at least partially located in the cavity encircled by the shell 100. In this embodiment, both the vaporization base 400 and the electrical connector 500 are partially exposed to the outside of the cavity encircled by the shell 100. However, in other embodiments, the vaporization base 400 and the electrical connector 500 may be completely accommodated in the cavity encircled by the shell 100. In this case, a protective cover may further be added to the outside of the shell 100 for protection and fastening.

Referring to FIG. 3, a liquid storage cavity 110 and an inhalation channel 120 that are relatively independent are provided on the shell 100. The liquid storage cavity 110 is configured to store a liquid vaporization medium, and the vaporization medium may be an aerosol generation substrate such as e-liquid, beautifying liquid, or coffee extract liquid. A liquid flowing hole 210 is provided on the top cap 200, the liquid flowing hole 210 is in communication with the liquid storage cavity 110, and the vaporization medium in the liquid storage cavity 110 may flow into the vaporization core 300 through the liquid flowing hole 210. When the vaporization core 300 works to generate heat, the vaporization medium on the vaporization core 300 may absorb the heat to form aerosols that can be inhaled by a user through vaporization, and the aerosols are absorbed by the user through the inhalation channel 120. Specifically, an end portion of the inhalation channel 120 forms a suction nozzle 121, and the user may perform inhalation at the suction nozzle 121, to absorb the aerosols in the inhalation channel 120.

The vaporization core 300 includes a substrate 310 and a heating body 320. The substrate 310 may be made of a porous ceramic material, so that the substrate 310 includes a large amount of micropores to form a specific porosity. According to the capillarity action of the micropores, the substrate 310 can transmit and buffer the vaporization medium. The substrate 310 includes a vaporization surface 311, and the heating body 320 is arranged on the vaporization surface 311. The heating body 320 may be made of a metal or alloy material, and the heating body 320 may be directly attached to the vaporization surface 311. Alternatively, a groove structure is provided on the vaporization surface 311, and the heating body 320 is embedded in the groove structure. The heating body 320 may be a line-shaped structure or may be a film-shaped structure. The heating body 320 is electrically connected to the electrical connector 500, and the electrical connector 500 may transmit currents to the heating body 320 to supply power, so that the heating body 320 converts electrical energy into heat required for vaporize the vaporization medium. Therefore, when the heating body 320 generates heat, the vaporization medium on the vaporization surface 311 and the vaporization medium infiltrated on a surface of the heating body 320 are vaporized to form aerosols.

Figure 4:
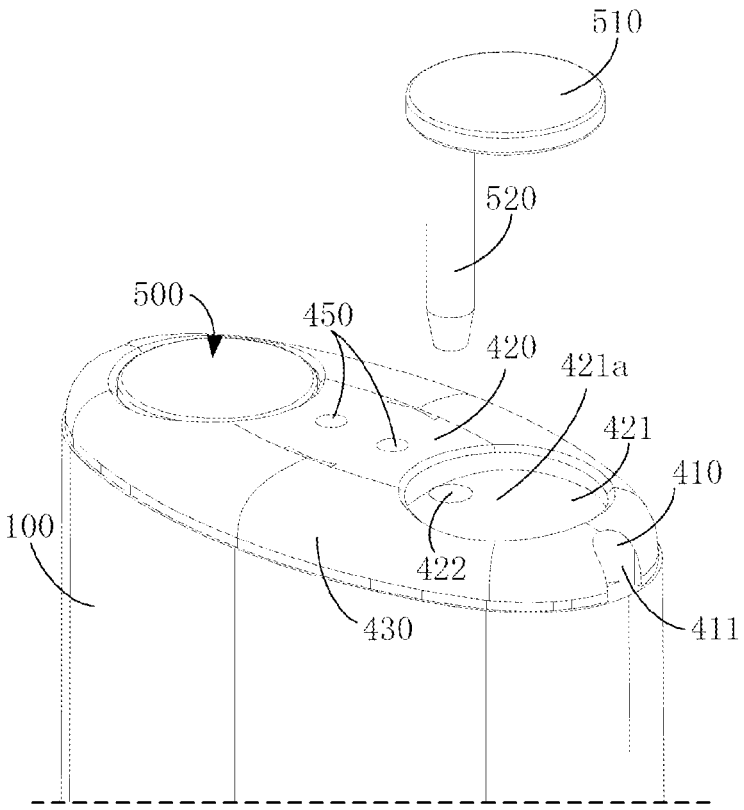
FIG. 4 is a schematic partial exploded structural view of the vaporizer shown in FIG. 3.

Referring to FIG. 3 and FIG. 4, the vaporization base 400 is at least partially accommodated in the cavity of the shell 100. For example, a part of the vaporization base 400 is accommodated in the cavity of the shell 100, and the other part of the vaporization base 400 is exposed to the outside of the shell 100. In another example, the vaporization base 400 may be completely accommodated in the cavity of the shell 100. The vaporization base 400 includes a side circumferential surface 430 and a bottom surface 420. In some embodiments, the side circumferential surface 430 and the bottom surface 420 are both located outside the shell 100 and are located on a side of the vaporization base 400 facing away from the vaporization component. The side circumferential surface 430 is in a circular structure and is connected surrounding the bottom surface 420, so that a normal direction of the side circumferential surface 430 and an axial direction of the entire vaporizer 10 form an inclined angle greater than zero. The bottom surface 420 is connected to a lower end of the side circumferential surface 430, and the bottom surface 420 is arranged perpendicular to the axial direction of the entire vaporizer 10, namely, the bottom surface 420 is a flat surface that is horizontally arranged. Referring to FIG. 2, the vaporization base 400 further includes an abutting surface 440. The abutting surface 440 is connected to an upper end of the side circumferential surface 430, and the abutting surface 440 may also be arranged approximately perpendicular to the axial direction of the entire vaporizer 10, namely, the abutting surface 440 is horizontally arranged. After the vaporization base 400 is mounted, an end portion (a lower end) of the shell 100 abuts against the abutting surface 440. Therefore, through the arrangement of the abutting surface 440, the side circumferential surface 430 and the bottom surface 420 may be both located outside the shell 100, and mounting of the shell 100 and the vaporization base 400 may be further limited, thereby improving the assembly efficiency and the assembly precision of the vaporization base 400.

Figure 5:
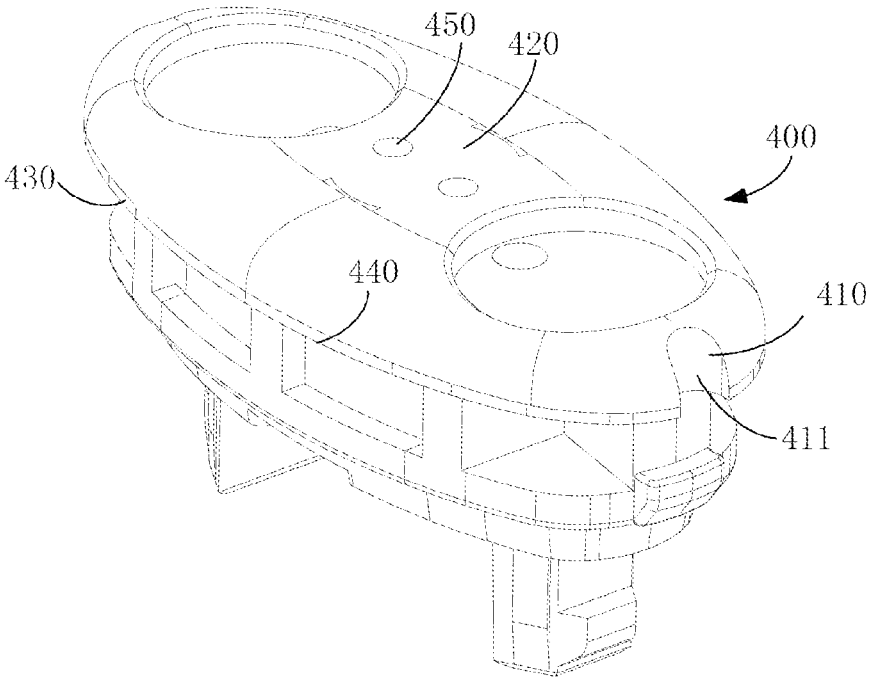
FIG. 5 is a three-dimensional schematic structural diagram of a first example of a vaporization base in the vaporizer shown in FIG. 3.
Figure 6:
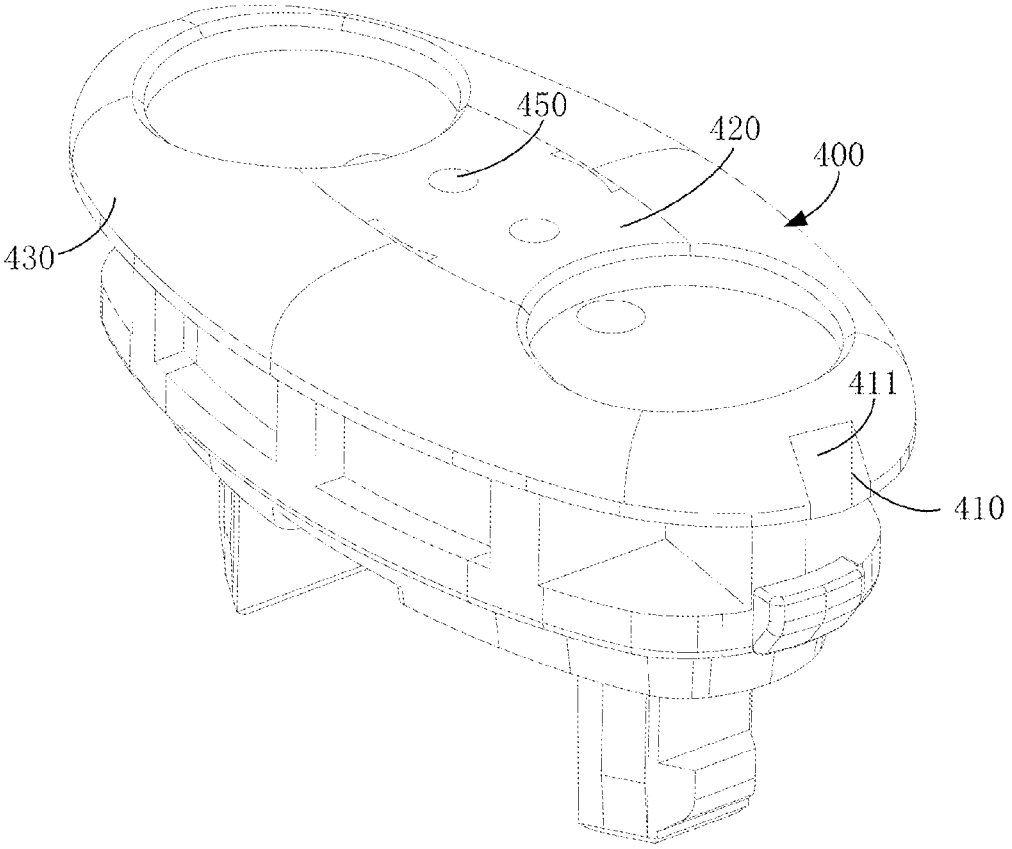
FIG. 6 is a three-dimensional schematic structural diagram of a second example of a vaporization base in the vaporizer shown in FIG. 3.

Referring to FIG. 4, FIG. 5, and FIG. 6, in some embodiments, at least one notch 410 is provided on the vaporization base 400, and when the vaporization base 400 is mounted, the notch 410 is configured to engage with a mounting fixture. The notch 410 may be provided on at least one of the bottom surface 420 and the side circumferential surface 430. Namely, the notch 410 may be independently provided on the bottom surface 420, or may be independently provided on the side circumferential surface 430, or may be provided on the bottom surface 420 and the side circumferential surface 430 simultaneously. A contour of a cross section of a part of the vaporization base 400 that is provided with the notch 410 is an ellipse or an ellipse-like shape. It may be understood that, the cross section of the vaporization base 400 is a cross section perpendicular to the vaporization base 400 and a central axis of the vaporizer 10. The contour structure of the vaporization base 400 matches a contour structure of the shell 100, to form a more aesthetic streamlined appearance. There may be at least two notches 410. For example, when there are two notches 410, the two notches 410 may be respectively provided on end portions of a major axis of the ellipse or ellipse-like shape. In this case, the two notches 410 are symmetrically provided relative to a minor axis of the ellipse or ellipse-like shape. The notches 410 may alternatively be provided on end portions of the minor axis of the ellipse or ellipse-like shape. In this case, the two notches 410 are symmetrically provided relative to the major axis of the ellipse or ellipse-like shape. In another example, when there are four notches 410, the notches 410 are provided on end portions of the major axis and the minor axis of the ellipse or ellipse-like shape.

In some embodiments, one cross section of the vaporization base 400 is used as a reference, and a shape of a projection of the notch 410 on the cross section may be at least one of a rectangle, a diamond, a circle, an ellipse, or a bow. The notch 410 includes a shaping surface 411, and at least a partial boundary of the notch 410 may be defined by the shaping surface 411. For example, referring to FIG. 1 and FIG. 2, when the projection of the notch 410 on the cross section is in a shape of a bow, the shaping surface 411 of the notch 410 is a flat surface; and when the flat shaping surface 411 intersects with a cross section of the vaporization base 400, an intersecting line formed through the intersection is a straight line. In another example, referring to FIG. 4 and FIG. 5, when the projection of the notch 410 on the cross section is in a shape of a circle or an ellipse, the shaping surface 411 of the notch 410 is a smooth transition curved surface; and when the shaping surface 411 intersects with a cross section of the vaporization base 400, an intersecting line formed through the intersection is a smooth transition curve. In another example, referring to FIG. 6, when the projection of the notch 410 on the cross section is in a shape of a rectangle, the shaping surface 411 of the notch 410 is a curved surface formed by a plurality of flat surfaces connected at angles; and when the shaping surface 411 intersects with a cross section of the vaporization base 400, an intersecting line formed through the intersection is a polyline.

Figure 9:
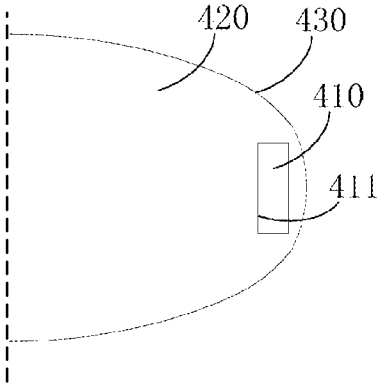
FIG. 9 is a schematic structural bottom view of a vaporizer according to a third embodiment.
Figure 10:
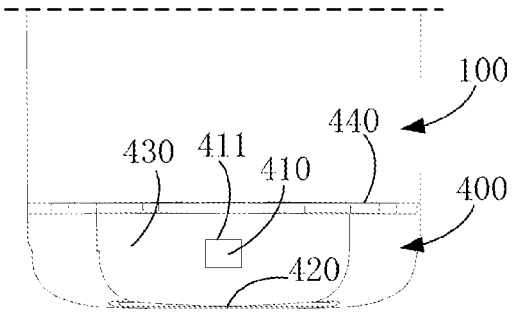
FIG. 10 is a schematic structural side view of a vaporizer according to a fourth embodiment.

In some embodiments, the cross section of the vaporization base 400 is used as a reference. An intersecting line of the cross section and the shaping surface 411 of the notch 410 may be a closed-loop line that is circumferentially closed. For example, referring to FIG. 9, the notch 410 actually is a hole structure, and the notch 410 is recessed by a specific depth in an axial direction of the vaporization base 400 on the bottom surface 420. Alternatively, the intersecting line of the cross section and the shaping surface 411 of the notch 410 may be an open-loop line that is not circumferentially closed. For example, referring to FIG. 4, FIG. 5, and FIG. 6, the notch 410 may be recessed by a specific depth on the side circumferential surface 430, and the notch 410 runs through the bottom surface 420 and the abutting surface 440 at the same time. A longitudinal section of the vaporization base 400 is used as a reference. Apparently, the longitudinal section is parallel to a central axis of the vaporization base 400, and an intersecting line of the longitudinal section and the shaping surface 411 of the notch 410 may be a closed-loop line that is circumferentially closed. For example, referring to FIG. 10, the notch 410 may be recessed by a specific depth on the side circumferential surface 430, the notch 410 does not run through the bottom surface 420 and the abutting surface 440, and the notch 410 actually is a hole structure.

Through the arrangement of the notch 410, when the mounting fixture engages with the notch 410, the notch 410 exerts a good limitation effect on the mounting fixture. During mounting of the vaporization base 400, the mounting fixture can be effectively prevented from sliding relative to the vaporization base 400, to prevent the mounting fixture from sliding relative to the vaporization base 400 or even sliding off the entire vaporization base 400, thereby ensuring that the mounting fixture can always clamp the vaporization base 400 stably and reliably through the notch 410, and ensuring that the mounting fixture can implement assembly of the vaporization base 400 through only one clamping, so that the mounting fixture does not need to clamp the vaporization base 400 repeatedly for a plurality of times. Therefore, the assembly efficiency of the vaporization base 400 is improved.

In addition, in the foregoing embodiments, after the vaporization base 400 and the shell 100 are mounted, the notch 410 is at least partially exposed to the outside of the shell 100, to prevent the mounting fixture from interfering with the shell 100, thereby ensuring simple operations during mounting. In some other embodiments, to prevent the mounting fixture from interfering with the shell 100, the notch 410 may alternatively not be at least partially exposed to the outside of the shell 100. For example, in the embodiments provided in FIG. 1 to FIG. 9, even if the vaporization base 400 is completely accommodated in the shell 100, an avoiding space can still be provided for the mounting fixture due to a specific formation position of the notch 410.

Referring to FIG. 3 and FIG. 4, in some embodiments, the electrical connector 500 includes an abutting portion 510 and a penetrating portion 520. The penetrating portion 520 is approximately a circular long rod-shaped structure, and the abutting portion 510 is approximately a flat disc-shaped structure, so that a cross-sectional dimension of the abutting portion 510 is greater than a cross-sectional dimension of the penetrating portion 520. It may be understood that, when the abutting portion 510 and the penetrating portion 520 are both a circumferential structure, a diameter of the abutting portion 510 is greater than a diameter of the penetrating portion 520. An orthographic projection of the penetrating portion 520 in an axial direction thereof may be completely or partially fall on the abutting portion 510. A counterbore 421 is provided on a side of the vaporization base 400 facing away from the vaporization component, which may be understood as that the counterbore 421 is recessed to be formed on the bottom surface 420. A mounting hole 422 is recessed to be formed on a bottom wall surface 421*a* of the counterbore 421, a recessed depth of the mounting hole 422 may be greater than a recessed depth of the counterbore 421, and a cross-sectional dimension of the counterbore 421 is greater than a cross-sectional dimension of the mounting hole 422. Specifically, a shape size of the counterbore 421 completely matches a shape size of the abutting portion 510, and a shape size of the mounting hole 422 completely matches a shape size of the penetrating portion 520. An opening on one end of the mounting hole 422 is located on a side of the vaporization base 400 facing the vaporization component, and an opening on the other end of the mounting hole 422 is located at an edge of the bottom wall surface 421*a*. Certainly, the mounting hole 422 may be located at a position of the edge of the bottom wall surface 421*a* that is closest to a center of symmetry of the bottom surface 420. During assembly of the electrical connector 500, the penetrating portion 520 engages with the mounting hole 422, so that a top end of the penetrating portion 520 and the heating body 320 on the vaporization core 300 abut against each other, to implement an electrical connection between the electrical connector 500 and the heating body 320. The abutting portion 510 and the counterbore 421 engage with each other, and the bottom wall surface 421*a* and the abutting portion 510 abut against each other. In this way, the mounting of the electrical connector 500 can be well limited, thereby ensuring the assembly precision and the assembly efficiency of the electrical connector 500. The penetrating portion 520 and the abutting portion 510 may be integrally formed, so that the entire electrical connector 500 is a member. In this way, assembly between a plurality of members is omitted, and the assembly efficiency can also be improved. During assembly, the penetrating portion 520 is in interference fit with the mounting hole 422, so that the assembly of the electrical connector 500 can be completed provided that the penetrating portion 520 is inserted into the mounting hole 422 without mounting of additional members for fixing, and the assembly efficiency can also be improved. A surface of an end portion of the abutting portion 510 away from the penetrating portion 520 may be flush with the bottom surface 420 of the vaporization base 400.

Figure 7:
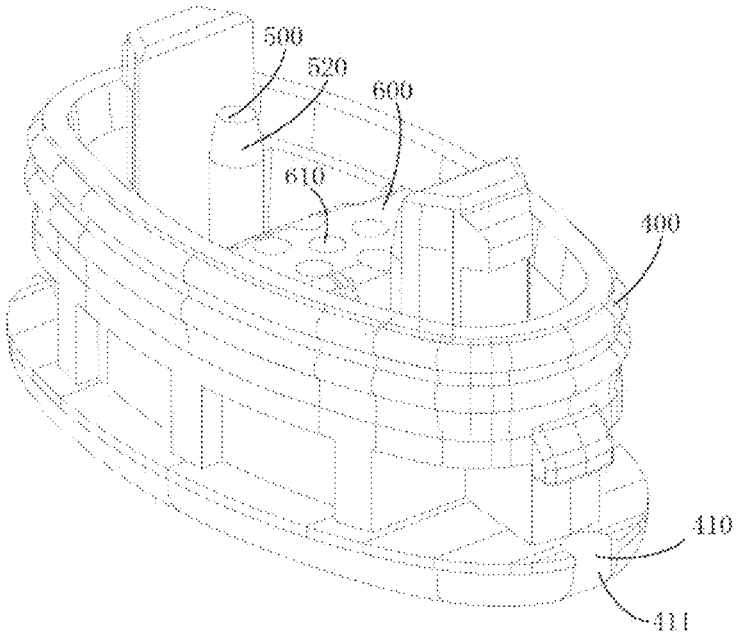
FIG. 7 is a three-dimensional schematic structural diagram of the vaporization base shown in FIG. 5 engaged with a seal member.
Figure 8:
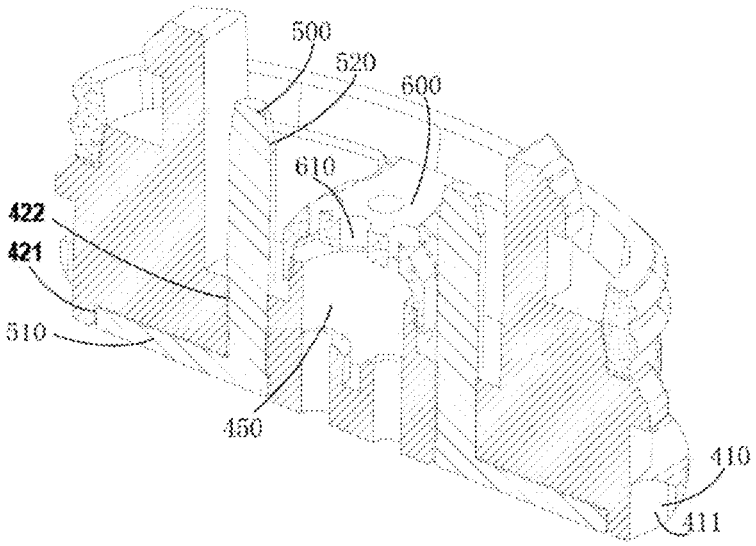
FIG. 8 is a three-dimensional schematic cross-sectional structural view of FIG. 7.

Referring to FIG. 7 and FIG. 8, an air inlet channel 450 is further provided on the vaporization base 400. When a user inhales, external air enters from the air inlet channel 450 and carries out the aerosols formed by the vaporization core 300 through vaporization, so that the aerosols are absorbed by the user. The vaporizer 10 further includes a seal member 600. The seal member 600 is sleeved on a side of the vaporization base 400 facing the vaporization component and abuts between the shell 100 and the vaporization base 400, thereby ensuring a good air impermeability of the vaporizer 10. The seal member 600 covers an upper end of the air inlet channel 450, a plurality of air guide holes 610 are provided on a part of the seal member 600 covering the air inlet channel 450, and the plurality of air guide holes 610 are in communication with the air inlet channel 450. For example, there may be six air guide holes 610, and a diameter of the air guide hole 610 may be about 0.8 mm. Referring to FIG. 3, when the user inhales, the external air sequentially flows through the air inlet channel 450 and the air guide hole 610 to enter the inhalation channel 120.

Figure 11:
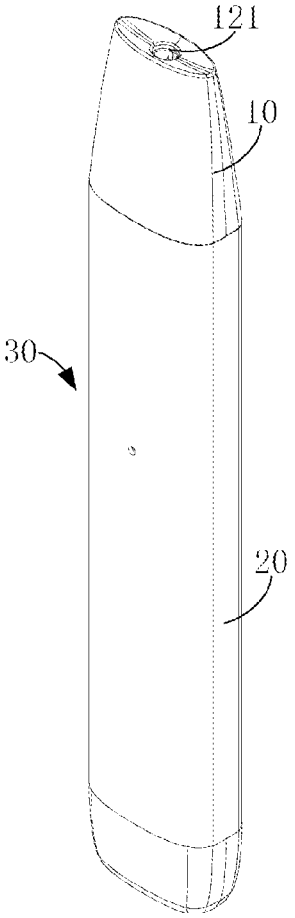
FIG. 11 is a three-dimensional schematic structural diagram of an electronic vaporization device according to an embodiment.

The present application further provides an electronic vaporization device 30 shown in FIG. 11. The electronic vaporization device 30 includes a power supply component 20 and a vaporizer 10, and the vaporizer 10 may be the vaporizer 10 provided in any one of the foregoing embodiments. The power supply component 20 and the vaporizer 10 may form a detachable connection relationship. After the vaporization medium in the liquid storage cavity 110 is consumed, the vaporizer 10 is detached from the power supply component 20 and is discarded, and a new vaporizer 10 filled with the vaporization medium in the vaporization cavity is loaded onto the power supply component 20. Therefore, the vaporizer 10 is a disposable product, and the power supply component 20 may be reused for a plurality of times. A battery in the power supply component 20 abuts against the abutting portion 510 of the electrical connector 500 through an ejector pin, to implement an electrical connection between the electrical connector 500 and the battery, so that the battery supplies power to the heating body 320 through the electrical connector 500. In view of that the abutting portion 510 includes a relatively large cross-sectional dimension, even if the vaporizer 10 has a relatively large mounting error, it can be still ensured that the abutting portion 510 is in contact with the ejector pin to implement the electrical connection between the electrical connector and the battery. Certainly, in other embodiments, the vaporizer 10 and the power supply component 20 may alternatively form a non-detachable connection relationship.

The technical features in the foregoing embodiments may be randomly combined. For concise description, not all possible combinations of the technical features in the embodiments are described. However, provided that combinations of the technical features do not conflict with each other, the combinations of the technical features are considered as falling within the scope described in this specification.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer comprising:

a shell including a liquid storage cavity;

a vaporization component comprising a vaporization core; and a vaporization base configured to seal one end of the shell, the vaporization component being disposed on the vaporization base such that the vaporization component is disposed between the vaporization base and the liquid storage cavity, wherein the vaporization base includes at least one notch, and wherein, upon mounting the vaporization base to the shell, the at least one notch is at least partially exposed to an outside of the shell.

2. The vaporizer of claim 1, wherein a contour of a cross section of a part of the vaporization base that is provided with the at least one notch comprises an ellipse or an ellipse-like shape, and wherein the at least one notch is provided on an end portion of a major axis and/or an end portion of a minor axis of the ellipse or ellipse-like shape.

3. The vaporizer of claim 2, wherein a shaping surface of the at least one notch comprises a flat surface.

4. The vaporizer of claim 2, wherein a shaping surface of the at least one notch comprises a curved surface.

5. The vaporizer of claim 4, wherein the curved surface is a smooth transition curved surface or a curved surface formed by a plurality of flat surfaces connected at angles.

6. The vaporizer of claim 1, wherein the at least one notch is provided on a side of the vaporization base facing away from the vaporization component.

7. The vaporizer of claim 6, wherein a shape of a projection of the at least one notch on a cross section of the vaporization base comprises at least one of a rectangle, a diamond, a circle, or an ellipse.

8. The vaporizer of claim 1, wherein the at least one notch comprises at least two notches, and wherein the at least two notches are symmetrically provided on the vaporization base.

9. The vaporizer of claim 1, wherein a counterbore is provided on a side of the vaporization base facing away from the vaporization component, wherein a mounting hole is provided on a side of the vaporization base facing the vaporization component, the mounting hole being in communication with the counterbore, a hole diameter of the counterbore being greater than a hole diameter of the mounting hole, and wherein the vaporizer further comprises an electrical connector configured to engage with the counterbore and the mounting hole.

10. The vaporizer of claim 1, further comprising:

a seal member sleeved on a side of the vaporization base facing the vaporization component, wherein an air inlet channel is provided on the vaporization base, and wherein a plurality of air guide holes for communication with the air inlet channel are provided on a part of the seal member covering the air inlet channel.

11. An electronic vaporization device, comprising:

a power supply component; and the vaporizer of claim 1, wherein the vaporizer is connected to the power supply component.

* * * * *